United States Patent [19]

Deutschländer

[11] 3,966,046

[45] June 29, 1976

[54] WRAPPER ASSEMBLY INCLUDING AN ARTICLE CARRIER ELEMENT

[75] Inventor: Gert Deutschländer, Neuhausen am Rheinfall, Switzerland

[73] Assignee: SIG Schweizerische Industrie-Gesellschaft, Neuhausen am Rheinfall, Switzerland

[22] Filed: Mar. 5, 1975

[21] Appl. No.: 555,457

[30] Foreign Application Priority Data

Mar. 5, 1974 Switzerland ..... 3122/74

[52] U.S. Cl. ..... 206/445; 206/495; 229/15; 229/87 F; 426/119

[51] Int. Cl.[2] ..... B65D 85/62

[58] Field of Search ..... 229/87 F, 42, 15, 31 R; 206/45.33, 526, 495, 445, 521; 426/119, 124, 128

[56] References Cited

UNITED STATES PATENTS

| | | | |
|---|---|---|---|
| 2,934,252 | 4/1960 | Wickstrom | 229/42 X |
| 3,627,116 | 12/1971 | Cooper | 206/45.33 |

*Primary Examiner*—Stephen P. Garbe
*Attorney, Agent, or Firm*—Spencer & Kaye

[57] ABSTRACT

A wrapper assembly for packaging articles includes a carrier element supporting the articles and a sleeve surrounding the carrier element and the articles. The carrier element comprises two compartments, each formed of a separate bottom wall, a separate lateral wall and at least one separate end wall. The two lateral walls are in a face-to-face contacting relationship.

4 Claims, 8 Drawing Figures

WRAPPER ASSEMBLY INCLUDING AN ARTICLE CARRIER ELEMENT

BACKGROUND OF THE INVENTION

This invention relates to a wrapper assembly having, for supporting the articles contained in the wrapper, a carrier element which forms two compartments, each receiving a group of flat, stacked articles. Known wrappers of this type have a number of disadvantages. In order to render the carrier element sufficiently stiff, there is needed a relatively large quantity of cardboard, corrugated paper or the like.

In known carrier elements in which the compartments have end walls, the compartments are not separated from one another by a partition in the completed condition; in other types of known carrier elements, on the other hand, the compartments are separated by partitions but they have no end walls. This is disadvantageous because, for example, it adversely affects the article charging step.

SUMMARY OF THE INVENTION

It is an object of the invention to provide an improved wrapper assembly of the above-outlined type, the carrier element of which has an increased stiffness, is more economical to make and is generally more adapted for the packaging operation.

This object and others to become apparent as the specification progresses, are accomplished by the invention, according to which, briefly stated, the carrier element has two juxtapositioned compartments which are formed each by a separate bottom, a separate lateral wall and at least one end wall and wherein the lateral walls of the two compartments are disposed in a face-to-face, contacting relationship.

DESCRIPTION OF THE PREFERRED EMBODIMENT

Figure 1:
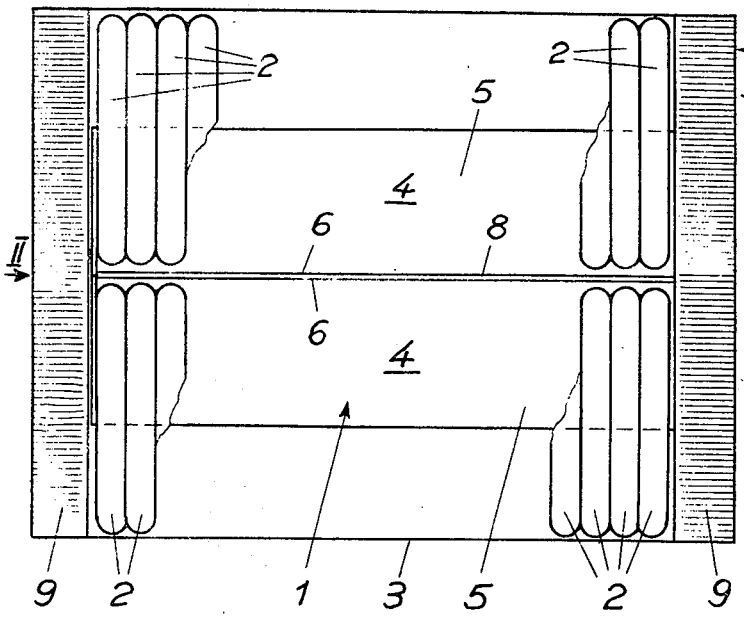
FIG. 1 is a top plan view of a preferred embodiment of the invention.
Figure 2:
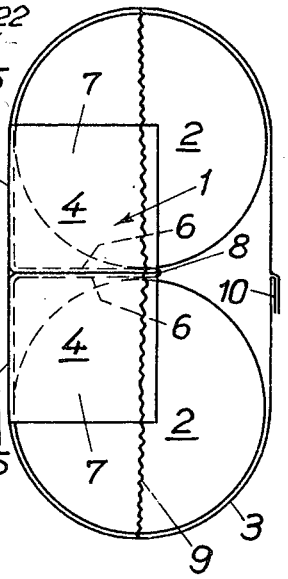
FIG. 2 is a side elevational view of the same embodiment taken in the direction of the arrow II of FIG. 1.

Turning now to FIGS. 1 and 2, the wrapper assembly shown therein which is particularly adapted to hold disc-shaped articles, such as cookies, in a stacked condition, includes a carrier element 1 for supporting two juxtapositioned groups of stacked articles 2 and a surrounding sleeve 3 which may be transparent. The carrier element 1 has two compartments 4, each formed of a bottom 5, a lateral wall 6 and an end wall 7. The compartments 4 are each filled with articles 2, of which only a few are shown in FIG. 1. The two lateral walls 6 are in a face-to-face engagement and are joined along a central longitudinal fold line 8. The articles 2 project beyond the outline of the end walls 7 and are retained in the compartments by the sleeve 3. In preparing the package, the sleeve 3 is, for example, positioned as a hose about the carrier element 1 and thus about the articles 2 received in the compartments 4. Thereafter, the hose is at both ends of the article stacks, closed in a known manner by transverse seams 9 and severed from adjoining sleeves. A longitudinal seam 10 provided for forming the hose is shown only in FIG. 2 in its flattened condition in which it lies against the sleeve material. The longitudinal seam 10 which, as shown in FIG. 2, is oriented towards the open side of the carrier element 1, could be formed at another side of the wrapper as well, for example, along its bottom. It is further to be understood that the sleeve 3 may be positioned about the carrier element 1 (charged with the articles 2) in any other desired manner.

It is to be noted that the carrier element 1 may be significantly smaller than known carrier elements, the compartments of which are, in cross section, approximately as large as the outline of the articles 2. Nevertheless, the wrapper assembly constructed according to the invention is stiffer and more stable than known wrappers because the carrier element 1 has dual lateral walls 6 separating the two compartments 4 from one another as well as a separate end wall 7 for each compartment 4. The carrier elements of known structure, in contradistinction, have either no end walls or no dual lateral walls. The cross-sectional outline of the compartments may be adapted to the outline of the articles if a particularly effective protection is to be accomplished. In such a case, it may be advisable to provide the compartments 4 at both ends with end walls 7. As it will be seen in the description that follows, the carrier element 1 may be made in a very simple manner of cardboard or the like without any waste or additional parts.

Figure 3:
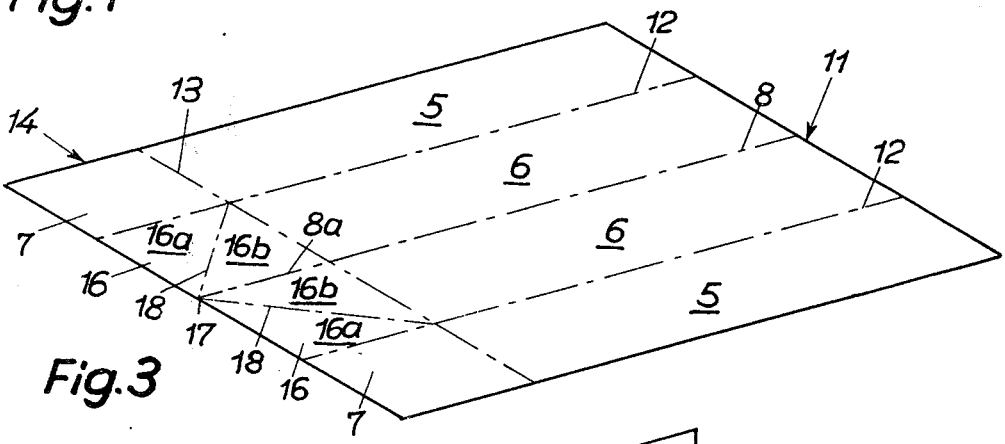
FIG. 3 is a perspective view of a scored cardboard blank from which a carrier element of the preferred embodiment is formed.

Turning now to FIG. 3, for making the carrier element 1, there is provided a rectangular cardboard sheet blank 11 which is scored with three parallel longitudinal fold lines, that is, a central longitudinal fold line 8 and two flanking longitudinal fold lines 12. The blank 11 is further scored with a transverse fold line 13. The fold lines 12 are situated between the bottoms 5 and the lateral walls 6, the width of which is the same as that of the bottoms 5. The transverse fold line 13 borders an edge strip 14 having a width equal to that of the bottoms 5 and the lateral walls 6. The edge strip 14 is subdivided by the two fold lines 12 and the fold line 8 into two outer squares 7 (which eventually constitute the end walls) and two inner squares 16. The two inner squares 16 are each further subdivided into two triangles **16*a* and 16*b* by means of two diagonal fold lines 18 which meet at the terminal point 17 of the longitudinal fold line 8**.

Figure 4:
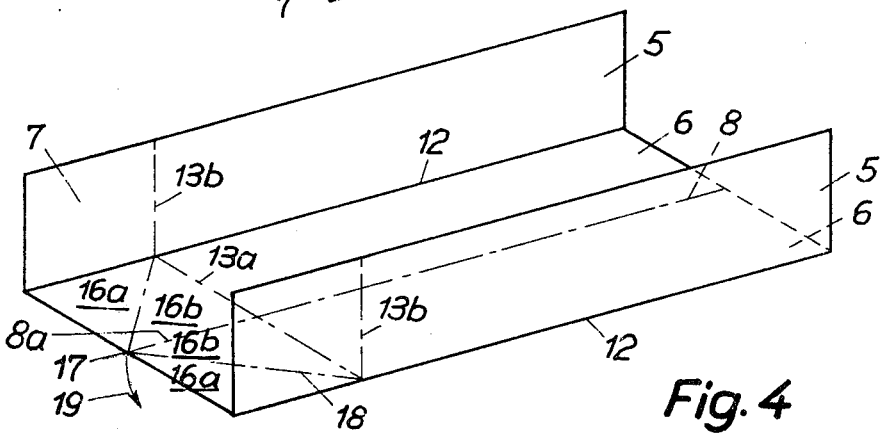
FIGS. 4–7 are perspective illustrations depicting consecutive phases of making a carrier element of the same embodiment.

Turning now to FIG. 4, the first step in making the carrier element 1 from the scored rectangular cardboard sheet 11 is to bend upwardly the two bottom panels 5 through 90° about the two longitudinal fold lines 12. Thereafter, the cardboard zone surrounding the terminal point 17 is pushed downwardly in the direction of the arrow 19.

Figure 5:
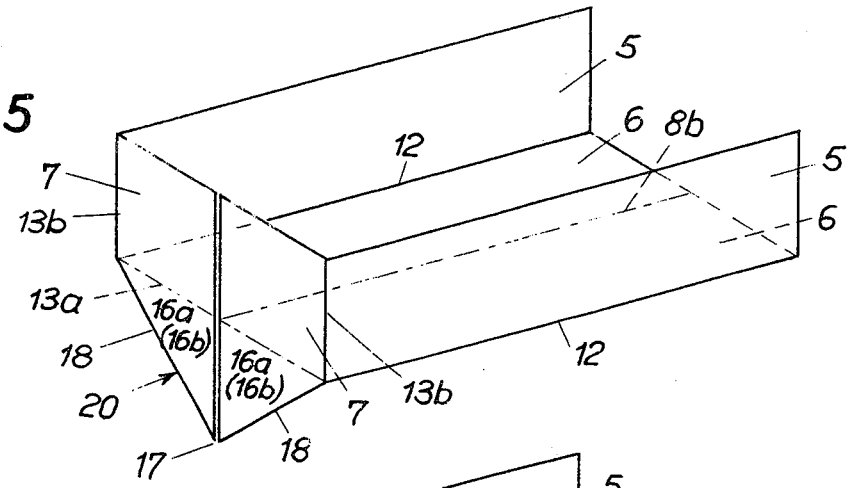
Figure 6:
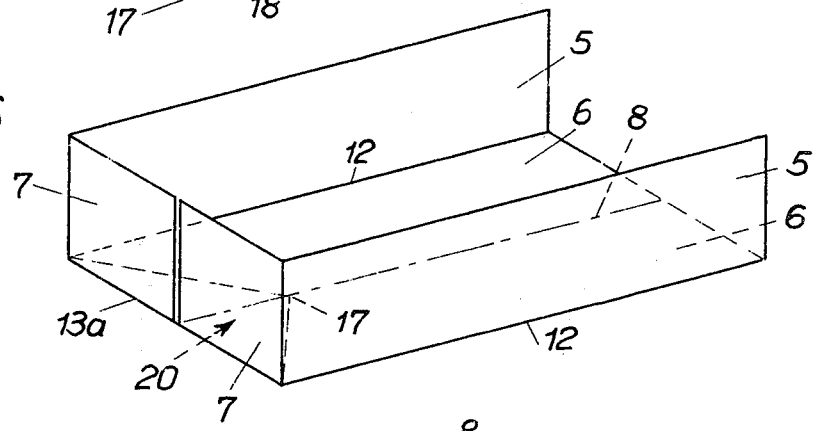
Figure 7:
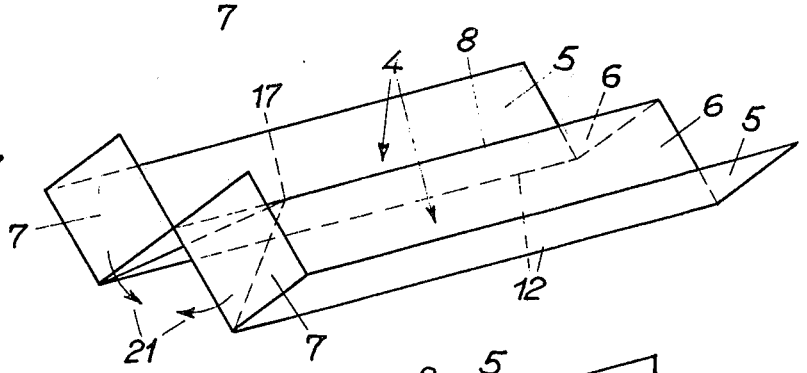
Figure 8:
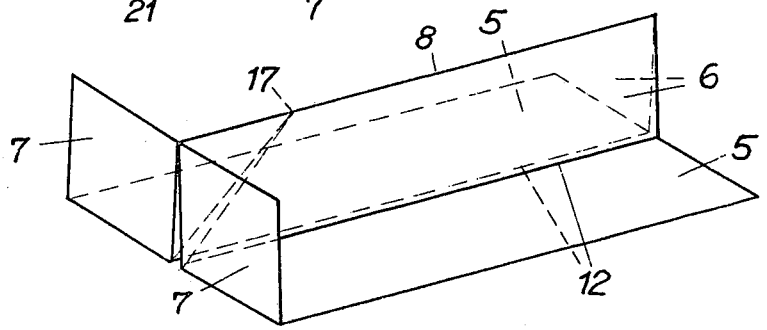
FIG. 8 is a perspective view of the completed carrier element of the same embodiment.

Turning now to FIG. 5, as a result of the downward folding in the direction of arrow 19, first, the triangles **16*b* are bent downwardly about the mid portion 13*a* of the fold line 13; second, the triangles 16*a* are bent upwardly about the diagonal lines 18 onto the triangle 16*b*; and third, the outer squares 7 of the edge strip 14 are folded about the outer portions 13*b* of the transverse fold line 13 until they are oriented perpendicularly to the bottoms 5 and the lateral walls 6. The two triangles 16***a* and the two triangles 16*b* now together form a double-walled triangular ear 20 which is bent upwardly about the fold line portion 13*a* until it lies flat against the two adjoining, presently coplanar lateral walls 6 as illustrated in FIG. 6. As a result of this last-described folding step, the portion 8*a* (FIG. 3) of the fold line 8, lying within the edge strip 14, will coincide with the fold line portion 8*b*. The configuration of FIG. 6 is then folded according to the arrows 21 of FIG. 7 about the fold line 8 so that the two lateral walls 6 will meet face-to-face and the two bottoms 5 will be in a juxtapositioned, coplanar relationship as it may be observed in FIG. 8. For making the individual panels more discernible in the completed, folded structure, FIG. 8 shows the carrier element as still having a small clearance between the two lateral walls 6.

The two dual-walled triangles 16*a*, 16*b* of the ear 20 lie, after being folded upwardly about the fold line portion 8*a*, between the lateral walls 6 which thus maintain four identical triangles in registry and in a face-to-face relationship. In this position it is feasible to secure the two lateral walls 6 to one another at several locations by means of an adhesive or staples. Advantageously, however, no such gluing or stapling is effected, since no real advantage is achieved with these time and material consuming steps which, furthermore, require more complex manufacturing mechanisms. The pressure exerted by the sleeve 3 through the articles 2 on the lateral walls 6 is fully sufficient to maintain these walls in a face-to-face relationship. The introduction of the flat articles 2 may be effected manually or by machine and may occur even before attaining the final configuration of the carrier element as shown in FIG. 8. In such a case it is advantageous to close the compartments 4 only at one end by an end wall 7. It is, however, feasible without difficulty to provide also at the right-hand side (as seen in FIG. 3) of the blank 11 an edge strip and fold it the same way as it has been described for the edge strip 14. The omission of a second end wall, however, has the following advantage: if the wrapper is positioned upright on its left-side end wall (as viewed in FIG. 1) while the corresponding transversal seam 9 is laid flat, then, in the direction of the arrow 22 of FIG. 1, it is possible to verify the type of goods that are within the wrapper, provided, of course, that the sleeve 3 is transparent on its upper side. Along the long sides and the underside, the sleeve is, in most cases, non-transparent and provided with printed information relating to contents, advertisements or pictures.

It is to be understood that the blank 11 may be made not only of a smooth cardboard but also of other types of relatively stiff sheet material, including corrugated paper.

It will be understood that the above description of the present invention is susceptible to various modifications, changes and adaptations, and the same are intended to be comprehended within the meaning and range of equivalents of the appended claims.

What is claimed is:

1. A wrapper assembly for packaging articles, including a carrier element supporting the articles and a sleeve surrounding the carrier element and the articles, the improvement wherein said carrier element is a one-piece member constituted of a folded blank having the shape of a rectangle; said carrier element comprising two compartments, each formed of a separate bottom wall, a separate lateral wall and at least one separate end wall, the two lateral walls being in a face-to-face contacting relationship.

2. A wrapper assembly as defined in claim 1, wherein each lateral wall has a first longitudinal edge remote from the bottom wall and a second longitudinal edge adjoining the bottom wall; said lateral walls are joined to one another along the first longitudinal edges by a first fold line extending longitudinally and centrally in said folded blank; each lateral wall is joined to a said separate bottom wall along the respective second longitudinal edges by respective second fold lines extending on either side of said first fold line in a parallel spaced relationship therewith; said end walls being formed of two external squares forming part of an edge strip extending transversely to said first and second fold lines; said edge strip has a middle zone formed of four identical triangles, said middle zone being folded between said lateral walls, with said triangles being positioned face-to-face and in registry with one another.

3. Wrapper assembly as defined in claim 2, wherein said lateral walls are maintained in their face-to-face contacting relationship solely by the force exerted by said sleeve through the articles.

4. Wrapper assembly as defined in claim 2, wherein the number of said at least one separate end wall is one.

* * * * *